United States Patent [19]

Plyler

[11] 4,185,787

[45] Jan. 29, 1980

[54] APPARATUS FOR MAKING WOOD SHAVINGS

[75] Inventor: Richard F. Plyler, Pageland, S.C.

[73] Assignee: Dennis Michael Plyler, Pageland, S.C. ; a part interest

[21] Appl. No.: 929,547

[22] Filed: Jul. 31, 1978

[51] Int. Cl.[2] ..... B02C 1/00; B02C 18/26

[52] U.S. Cl. ..... 241/101.5; 144/178; 144/180; 241/277; 241/283

[58] Field of Search ..... 144/162 R, 178, 180; 241/28, 101.5, 205, 283, 277, 280

[56] References Cited

U.S. PATENT DOCUMENTS

| | | | |
|---|---|---|---|
| 1,476,032 | 12/1923 | Aicher et al. | 241/277 X |
| 1,795,064 | 3/1931 | Wiener | 241/283 X |
| 3,255,070 | 6/1966 | Bersano | 241/280 X |
| 3,286,745 | 11/1966 | Meis | 241/277 X |

*Primary Examiner*—Mark Rosenbaum

*Attorney, Agent, or Firm*—Bell, Seltzer, Park & Gibson

[57] ABSTRACT

Wood shavings suitable for use as absorbent bedding litter for poultry or other animals are produced at a high rate of production by a machine which includes an elongate open-bottomed stationary hopper adapted for receiving a supply of elongate wood pieces for being formed into wood shavings, with an elongate carriage positioned lengthwise beneath the elongate hopper and closely adjacent the open bottom thereof. A series of transversely extending rotating cutters is carried by the carriage at spaced locations along the length of the carriage, with the cutters being adapted for engaging the wood pieces in the lowermost portion of the hopper at spaced locations along the length of the pieces. The carriage is moved in a reciprocating manner over a predetermined relatively short stroke of movement substantially less than the length of the hopper and such that the cutters of the series collectively engage and form shavings from the elongate wood pieces over the entire length of the wood pieces.

18 Claims, 12 Drawing Figures

APPARATUS FOR MAKING WOOD SHAVINGS

FIELD OF THE INVENTION

This invention relates to an apparatus for producing wood shavings which may be used as an absorbent bedding litter for poultry or other animals.

BACKGROUND ART

Among the machines heretofore known or proposed for producing wood shavings suitable for use as animal litter are the machines shown in Meis U.S. Pat. No. 3,286,745 and Hassler et al U.S. Pat. No. 2,442,492. These wood shaving machines are designed for producing shavings from relatively short pieces of wood only several feet in length, and when relatively long wood pieces are available as raw material it is necessary to cut the pieces of wood into shorter lengths before they can be supplied to the wood shaving machine. Also, these machines are rather difficult to load with wood pieces and are not particularly adaptable to automated feeding of the wood pieces.

SUMMARY OF THE INVENTION

With the foregoing in mind, it is an important object of the present invention to provide an improved machine for producing wood shavings which is capable of receiving relatively long pieces of wood from which to produce wood shavings, and more specifically, it is an object of this invention to provide a machine which is particularly suited for using the exterior slab portions of logs which are produced as a waste product by sawmills in the production of dimensioned lumber.

It is a further object of this invention to provide a machine which is capable of producing shavings at a considerably higher rate of production than heretofore possible.

It is a further object of this invention to provide a high capacity machine of the type described which is capable of substantially continuous operation and provides for maintaining a continuous supply of raw material as well as for continuously removing the shavings being produced.

These and other objects are accomplished in accordance with the present invention by an apparatus which comprises an elongate open-bottomed stationary hopper adapted for receiving a supply of elongate wood pieces for being formed into wood shavings, and with an elongate carriage positioned lengthwise beneath the elongate hopper and closely adjacent the open bottom thereof. A series of transversely extending cutters is carried by the carriage at spaced locations along the length thereof, with the cutters being adapted for engaging the wood pieces in the lowermost position of the hopper at spaced locations along the length of the pieces. The carriage is moved in a reciprocating manner over a predetermined stroke of movement such that the cutters of the series collectively engage and form shavings from the elongate wood pieces over the entire length of the wood pieces.

The cutters are arranged in successive pairs of counter-rotating cutters, with one of the cutters of each pair being adapted for forming shavings from the wood pieces during movement of the carriage in one direction, and the other cutter of each pair being adapted for forming shavings from the wood pieces during movement of the carriage in the opposite direction.

A conveyor system associated with the stationary hopper keeps the hopper supplied with elongate wood pieces. Another conveyor system located beneath the reciprocating carriage receives the wood shavings which are produced by the cutters and transports the shavings to a remote location where they may be loaded into a motor vehicle.

BRIEF DESCRIPTION OF THE DRAWINGS

Some of the objects and features of the invention having been described, others will become apparent as the description proceeds when taken in connection with the accompanying drawings, in which—

DESCRIPTION OF ILLUSTRATED EMBODIMENT

Figure 1:
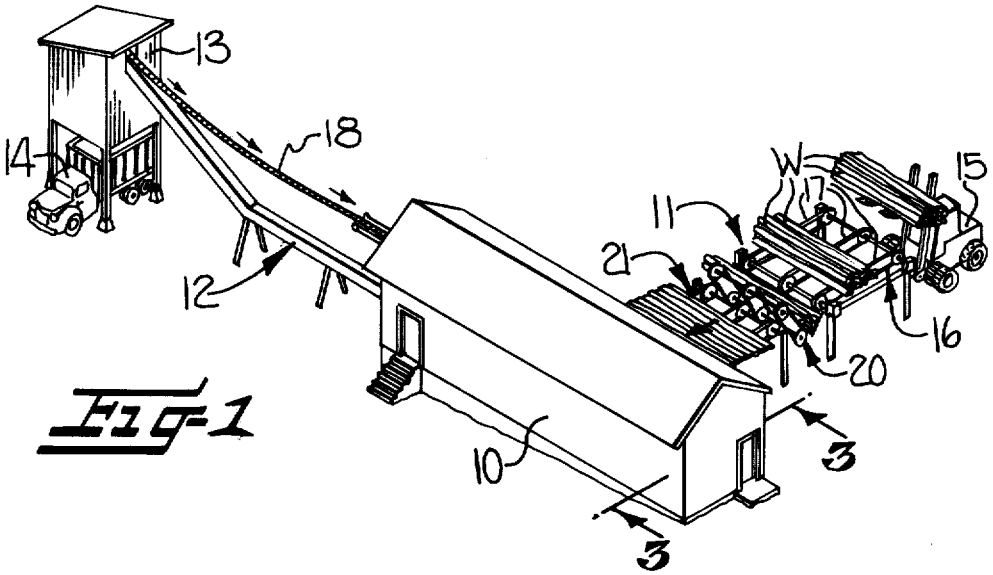
FIG. 1 is a perspective view showing an installation of an apparatus for producing wood shavings in accordance with this invention.

Referring more particularly to the drawings, there is illustrated in FIG. 1 a suitable arrangement of apparatus for manufacturing wood shavings in accordance with this invention. As illustrated, an elongate building 10 is provided for housing the apparatus for producing the wood shavings, and a conveyor system 11 is provided alongside the building for supplying elongate wood pieces W to the building for being converted into wood shavings. A conveyor system, generally indicated at 12, is also provided for conveying the wood shavings from the building 10 to a remote loading facility 13 where the shavings may be loaded into a truck 14 or other suitable vehicle.

The supply conveyor system 11 is adapted for receiving the wood pieces W in piles from a forklift truck 15, and for conveying the pieces individually and successively to the apparatus located within building 10.

Typically, the wood pieces W that are used as a raw material in the apparatus of this invention are the rounded exterior portions or slabs which are produced incident to the manufacture of dimensioned lumber in a conventional sawmill operation. The wood pieces W are thus of a length corresponding to the length of the logs being processed by the sawmill operation, which is usually approximately sixteen feet.

As illustrated, the supply conveyor system 11 for the wood pieces W includes two portions. The first portion is a receiving conveyor 16 adapted for receiving relatively large stacks or piles of the pieces W from a fork-lift truck 15 or other suitable means. The receiving conveyor 16 includes three parallel arranged generally horizontally extending endless chains 17 (FIG. 2) adapted for supporting and conveying the stacks or piles of wood pieces W. The second portion of the conveyor system 11 is located at the discharge end of the receiving conveyor and is adapted to receive the stacks or piles of pieces W and individually convey the respective pieces to the apparatus located in building 10. As illustrated, the second portion of the conveyor system includes two successively arranged conveyors, a sorter conveyor 20 and a delivery conveyor 21. The sorter conveyor 20 includes three parallel arranged endless chains 22 (FIG. 2) which are positioned with their lowermost end located beneath the discharge end of the chains 16 of the receiving conveyor and which extend angularly upwardly therefrom. The respective chains 22 includes successively arranged projections or flights adapted for engaging the respective wood pieces and lifting the same angularly upwardly toward the delivery conveyor 21. The delivery conveyor 21 includes three parallel arranged generally horizontally extending smooth-surfaced chains 23 adapted for receiving the successive individual pieces from the sorter conveyor and transporting them to the shaving apparatus located in building 10.

Figure 2:
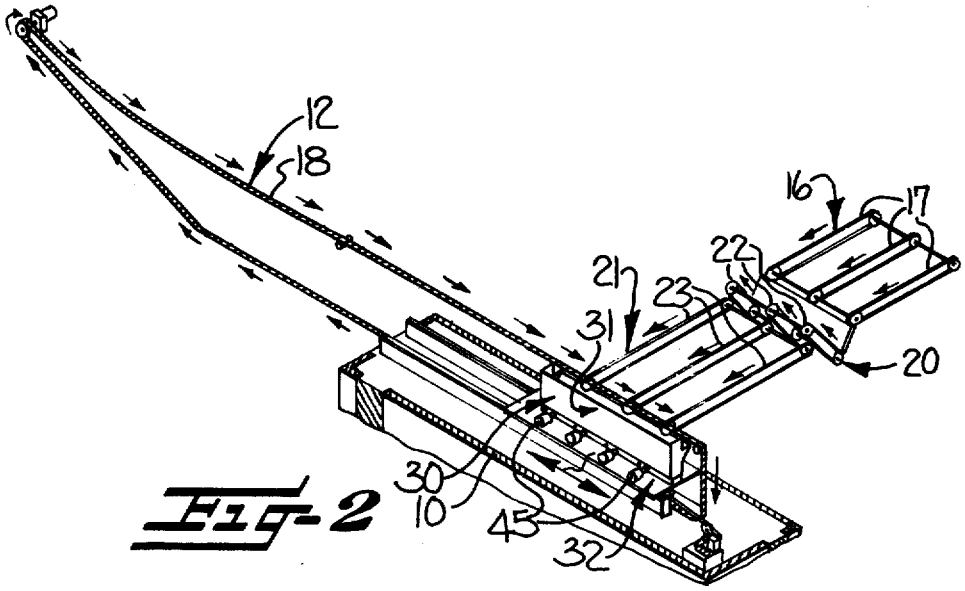
FIG. 2 is a somewhat schematic view similar to FIG. 1 which more clearly shows the various components of the apparatus of this invention.

Referring now to FIG. 2, the wood shaving apparatus located in building 10 is generally indicated by the reference character 30 and includes an elongate open-bottomed stationary hopper 31 positioned at the discharge end of the delivery conveyor 21 and adapted for receiving a supply of the elongate wood pieces W for being formed into wood shavings.

Mounted directly beneath the elongate hopper 31 is an elongate movable carriage 32. A series of transversely extending rotating cutters 40 is mounted on the carriage 32 at longitudinally spaced locations along the length of the carriage and are adapted for engaging the elongate wood pieces W in the lowermost portion of the hopper 31 at a series of spaced locations along the length of the pieces and for forming wood shavings from the wood pieces. The carriage 32 is mounted for movement along a predetermined longitudinal path of travel and in a reciprocating manner as described more fully hereinafter such that the respective cutters 40 collectively engage and form shavings from the elongate wood pieces W over the entire length of the wood pieces.

The shavings formed by the cutters 40 fall to a collection area located beneath the carriage 32 where they are received by conveyor system 12 and transported to a loading facility 13 at a suitable remote location from the building 10. In the illustrated embodiment, the conveyor system 12 comprises an endless drag chain 18 of the type conventionally used in many applications for conveying loose solid materials. However, it will be readily appreciated by those skilled in the art that other types of materials handling systems could be employed for conveying the shavings to the remote loading facility. At the remote loading facility 13, the shavings are accumulated in a temporary storage hopper and periodically dumped into a truck 14 or other suitable vehicle.

The overall construction and general operation of the apparatus of this invention having now been described, the following more detailed description of the apparatus will best be understood in connection with FIGS. 3, 5, 6 and 7 of the drawings. As illustrated therein, vertical beams 33 and horizontal cross members 34 support the elongate open-bottomed hopper 31 in suspended relation above the movable carriage 32. The hopper 31 has a length somewhat greater than the maximum length of the wood pieces W to provide adequate room for receiving the elongate wood pieces from the delivery conveyor 21, and has a height adapted for maintaining a supply of pieces W several feet in thickness so that the weight of the mass of pieces in the hopper forces the lowermost pieces into contact with the cutters 40.

Preferably, the hopper 31 is kept filled with wood pieces W to a substantially uniform depth so that a substantially uniform force is exerted on the lowermost pieces against the cutters 40. This may be suitably accomplished in accordance with the present invention by running the delivery conveyor 21 continuously at a relatively slow rate of speed, but in excess of the rate of consumption of wood pieces by the cutters. When the wood pieces are consumed and the level falls in the hopper, additional pieces are distributed into the hopper from the conveyor 21. However, when the hopper is sufficiently filled, the pieces create a "log jam" preventing additional pieces from being discharged into the hopper and the smooth surfaced conveyor chains 23 merely slide beneath the wood pieces. The conveyor chains 23 are driven by a motor 24 and suitable right angle gear reducer 25.

The carriage 32 is of elongate generally rectangular construction including a series of cross members 35 at longitudinally spaced locations along the length of the carriage and a pair of elongate beams 36 welded or otherwise suitably secured to the cross members 35 and extending lengthwise the entire length of the carriage. Longitudinally extending channel members 37 and 38 mounted at each end of the cross members 35 define the opposite sides of the carriage and serve as a foundation for mounting the motors for the cutters 40.

Figure 6:
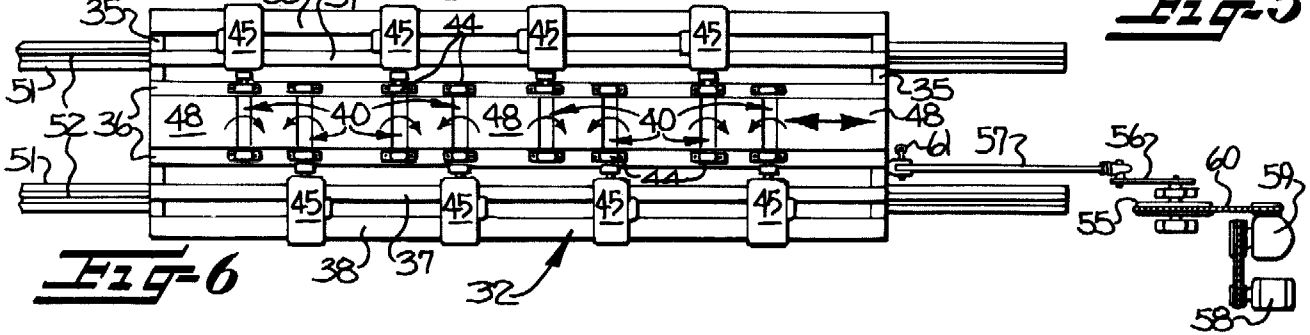
FIG. 6 is a plan view of the apparatus taken substantially along the line 6—6 of FIG. 5.
Figure 7:
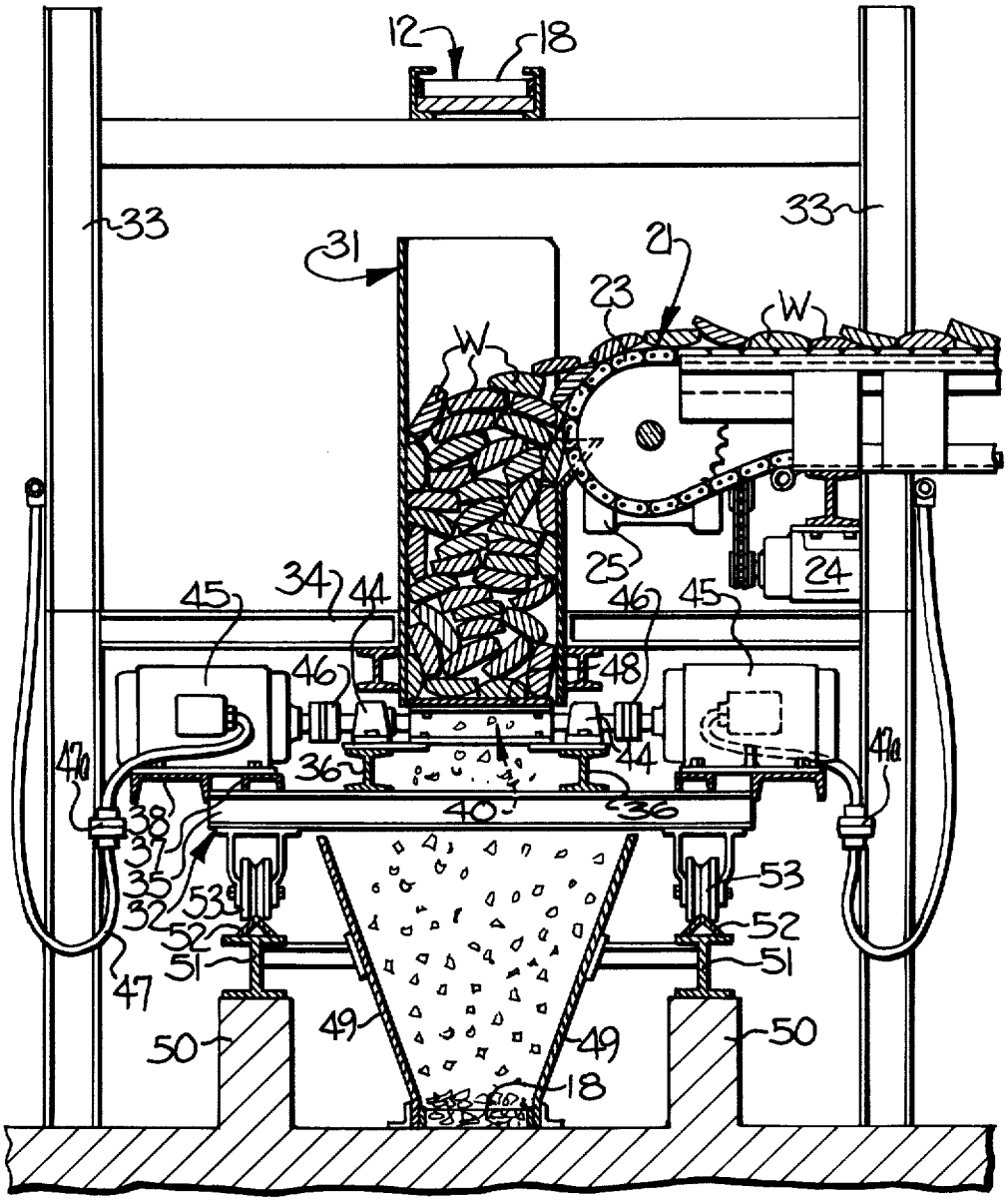
FIG. 7 is a cross sectional view of the apparatus taken substantially along the line 7—7 of FIG. 5.

In the embodiment illustrated herein, the cutters 40 are arranged in successive pairs of counter-rotating cutters at longitudinally spaced locations along the entire length of the carriage 32. As best seen in FIG. 6, four pairs of cutters are provided on the carriage 32, and the longitudinal spacing between the cutters in each pair is less than the longitudinal spacing between the cutters of adjacent pairs, with the overall effective length of the series of cutters being about the same as the length of hopper 31. As illustrated, the cutters of each pair rotate in opposite directions so that one of the cutters of each pair is adapted for forming shavings from the wood pieces during movement of the carriage in one direction, and the other cutter of each pair is adapted for forming shavings from the wood pieces during movement of the carriage in the opposite direction.

Figure 4:
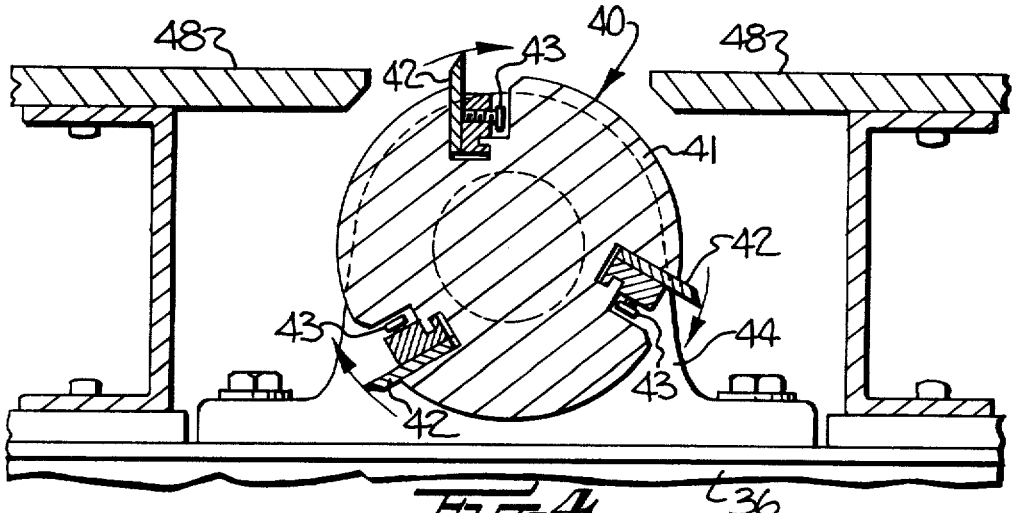
FIG. 4 is a cross sectional view taken substantially along the line 4—4 of FIG. 3 and showing one of the cutters used to produce wood shavings.
Figure 5:
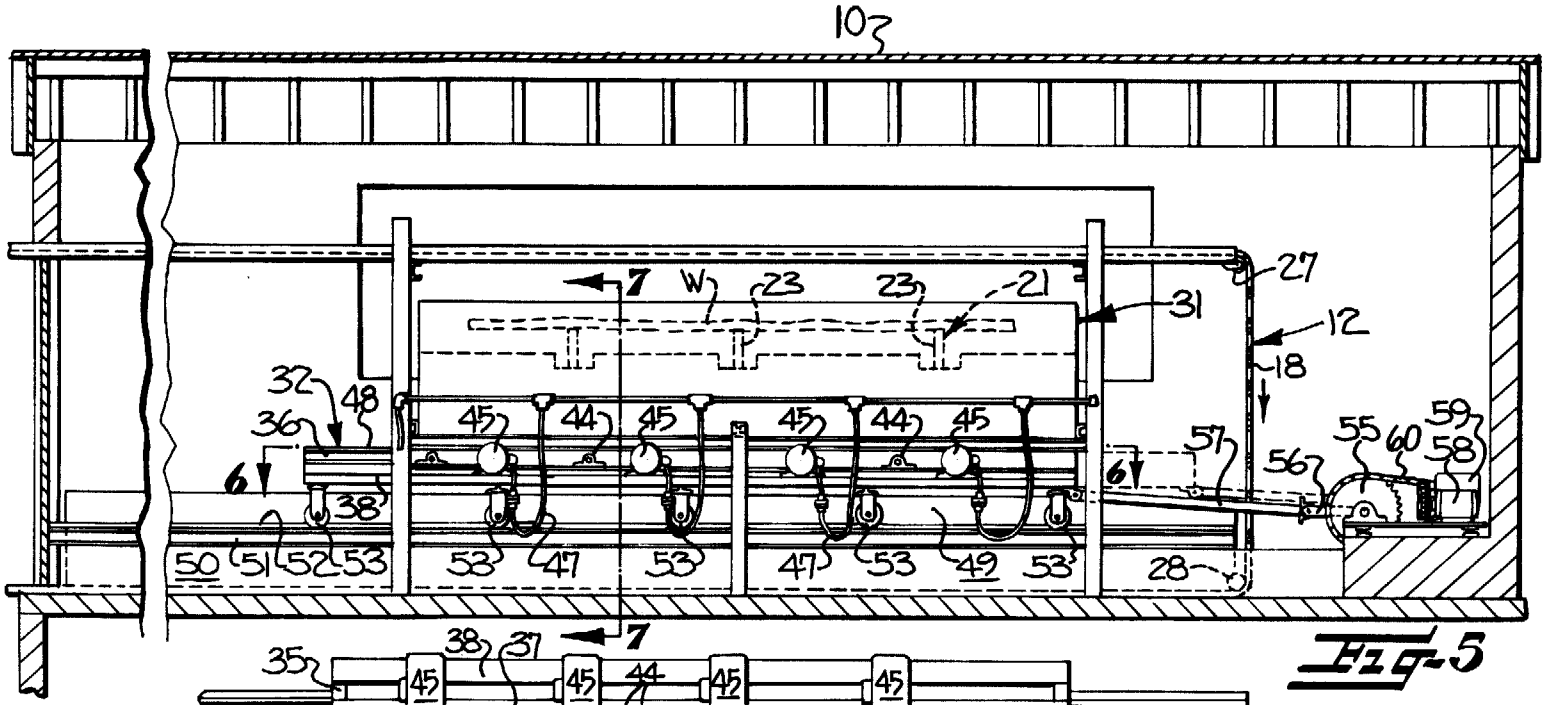
FIG. 5 is a side elevational view of the apparatus taken substantially along the line 5—5 of FIG. 3.

As best illustrated in FIG. 4, each cutter 40 includes an elongate generally cylindrical drum 41 of a length corresponding substantially to the width dimension of the hopper 31. A plurality of blades 42 are mounted to the drum by suitable securement means 43 and extend outwardly from the circumferential surface of the drum 41. Bearings 44 carried by the elongate beams 36 of the carriage mount the cylindrical drum 41 for rotation on the carriage. Each cutter is driven by an individual heavy duty electric motor 45 mounted on the channel members 37, 38 of the carriage, with the motor shaft being connected to the cylindrical drum 41 through a flexible connector coupling 46. The motors 45 are located along both sides of the carriage 32, with the motor for one cutter of each pair being located on one side of the carriage and the motor for the other cutter of the pair being located on the opposite side of the carriage. Flexible electric cables 47 supply electric power to each motor.

To support the elongate wood pieces in the open-bottomed hopper 31, support members are provided on the carriage 32 between the respective cutters 40. As illustrated, these support members take the form of horizontally extending support plates 48 carried by the underlying frame members of the carriage 32. The plates 48 extend between each successive cutter 40 and serve to engage and support the elongate wood pieces in the open-bottomed hopper during the reciprocating movement of the carriage relative to the hopper. The upper surfaces of the support plates 48 are positioned a short distance below the uppermost extent of the cutter blades 42 to thereby limit the depth of cut of the cutter blades.

Located beneath the carriage 32 are a pair of converging walls 49 which extend beyond each end of the carriage 32 and define a chute to direct the wood shavings downwardly from the cutters onto the drag chain 18 of the conveyor system 12. In its return run from the remote loading facility 13, the drag chain 18 passes along an overhead guide 26 above the hopper 31. Upon reaching the end of the hopper, the drag chain 18 passes over guide rollers 27 and 28, and is then directed along the bottom of the chute so as to receive and convey the wood shavings being formed by the cutters.

Figure 3:
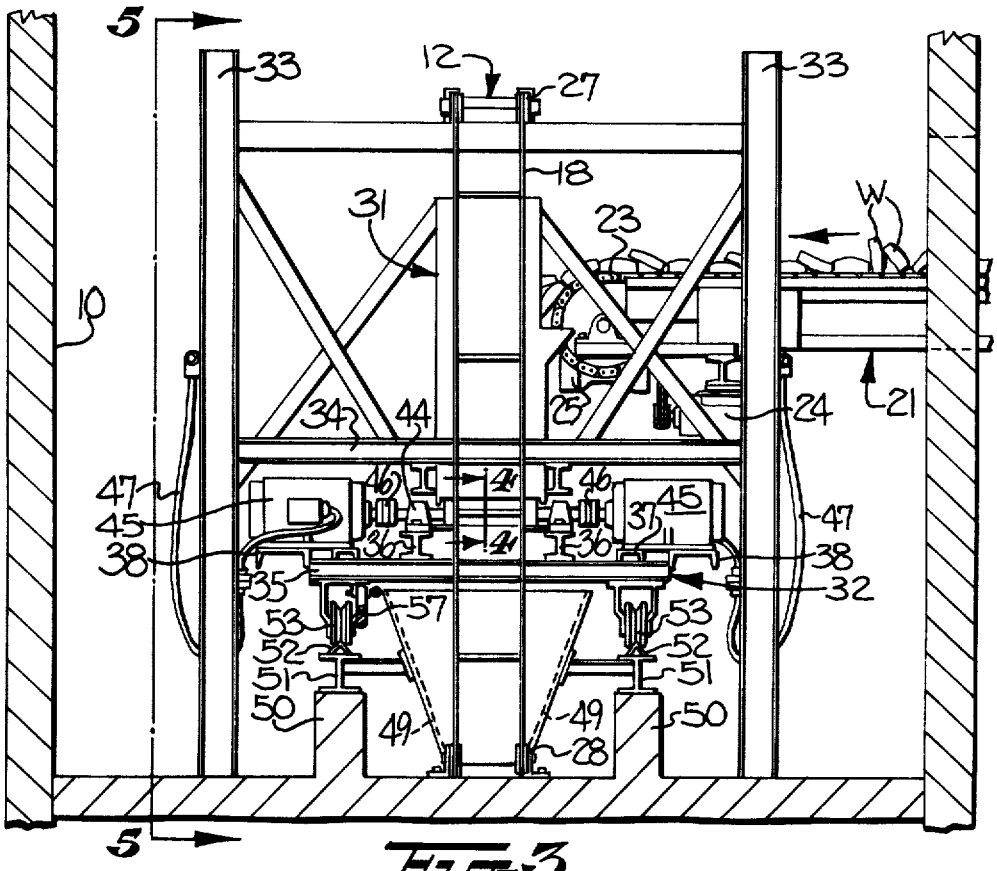
FIG. 3 is an elevational view taken substantially along the line 3—3 of FIG. 1 and showing one end of the apparatus.

As best seen in FIG. 3, the floor of building 10 includes a pair of upstanding support walls 50 which extend lengthwise of building 10 beneath the hopper 31 and the carriage 32. A longitudinally extending I-beam 51 is mounted on each support wall 50, and an inverted angle iron member 52 is welded or otherwise suitably secured to the upper surface of the I-beam 51. The angle iron members 52 collectively define an elongate trackway underlying the carriage 32. Respective wheels 53 are mounted to the underside of the carriage 32 and engage the angle iron members 52 so as to mount the carriage 32 for movement along the elongate trackway.

The carriage 32 is moved along the trackway in a reciprocating manner over a stroke of movement considerably less than the length of the hopper 31 by a drive mechanism 54. More particularly, at one end of the building 10 there is provided a large sprocket 55 to which a crank arm 56 is connected. The crank arm 56 is connected to the carriage 32 by an elongate connector member 57. Thus, when the sprocket 55 is rotated, the carriage 32 is moved in a reciprocating manner along the trackway beneath the stationary hopper 31. The sprocket 55 is rotated at a relatively slow rate of speed by a motor 58, a gear reducer 59, and a drive chain 60. The length of crank arm 56 corresponds to slightly more than half the distance between corresponding cutters 40 of adjacent pairs. In this manner, the crank arm 56 imparts to the carriage 32 a predetermined reciprocating stroke of movement which is relatively short and which corresponds substantially to the spacing between corresponding cutters of adjacent pairs. Thus, each pair of cutters engages and forms shavings from the wood pieces over a portion of the length of the wood pieces, with the respective pairs of cutters collectively engaging and forming shavings from the the elongate wood pieces over the entire length of the wood pieces.

As best seen in FIG. 2, the elongate trackway is considerably longer than the length of the stationary hopper 31 and carriage 32, and the trackway extends longitudinally beyond one end of the hopper 31 for a considerable distance. This is to permit moving the carriage 32 along the trackway from beneath the hopper in order to provide access to the cutters for servicing and for sharpening of the blades 42. When it is necessary to so move the carriage, the carriage is disconnected from the crank mechanism by removing the removable pin 61 (FIG. 6) which joins the connector member 57 to the carriage 32. In addition, each electric motor 45 is disconnected from its source of electrical power by unplugging the removable connector plug **47*a* associated with the flexible electrical cable 47** leading to each motor.

Figure 8:
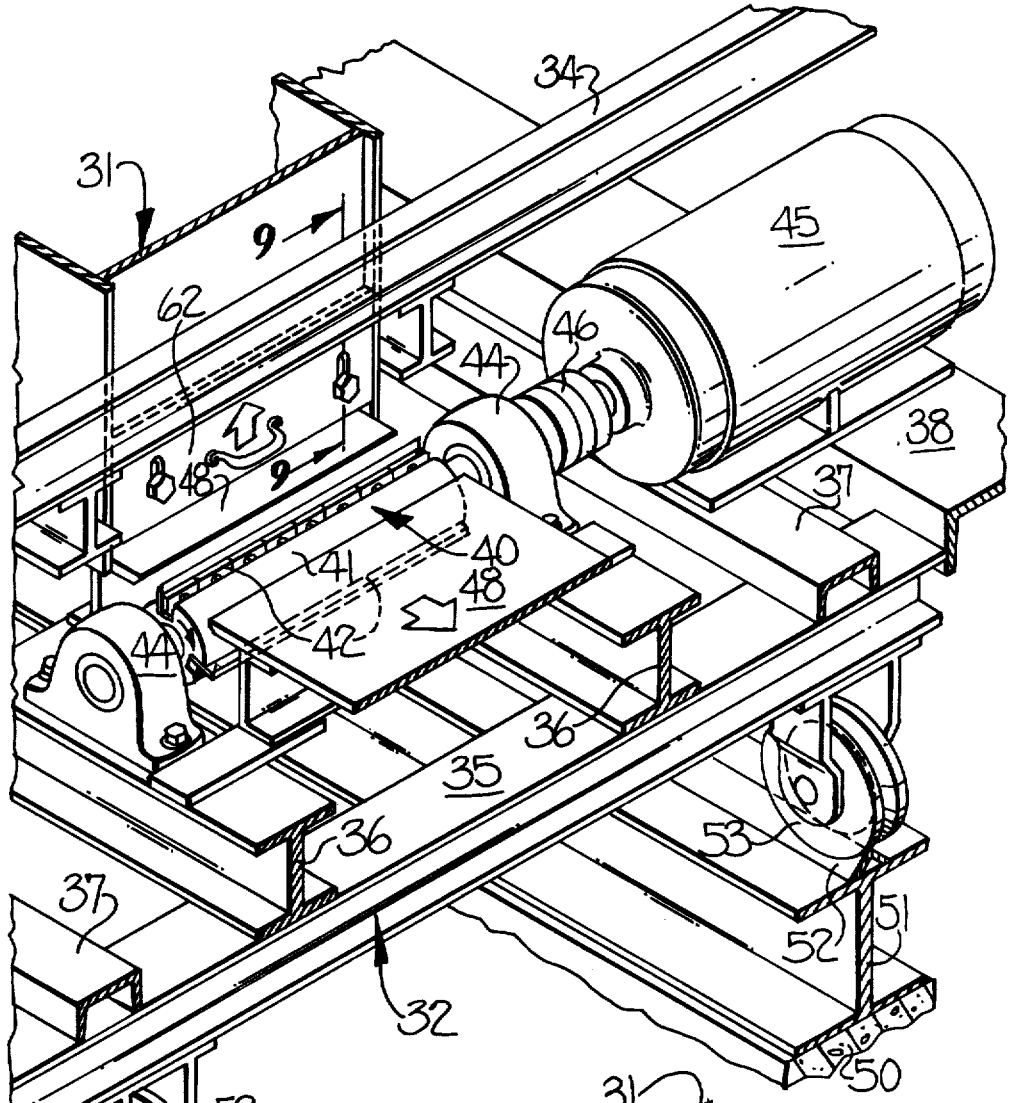
FIG. 8 is a fragmentary perspective view of one end of the apparatus as viewed from the arrow 8 in FIGS. 5 and 6.
Figure 9:
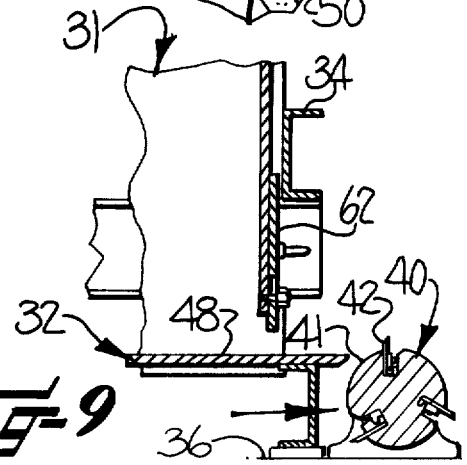
FIG. 9 is a fragmentary cross sectional view of the apparatus taken substantially along the line 9—9 of FIG. 8.

For safety reasons, the exposed edges of the cutter blades 42 are normally confined within the stationary hopper 31. More particularly, it will be seen from FIG. 8 that the support plates 48 are located between the lowermost portions of the side walls of the hopper so that the upstanding exposed portions of cutter blades 42 are confined within the hopper 31. In order to provide clearance between the cutter blades 42 and the end wall of the hopper 31 when removing the carriage 32 from beneath the hopper, the end wall is, as illustrated, provided with a sliding panel 62 which may be raised a short distance to provide sufficient clearance to permit removal of the carriage 32 from beneath the hopper 31.

Figure 10:
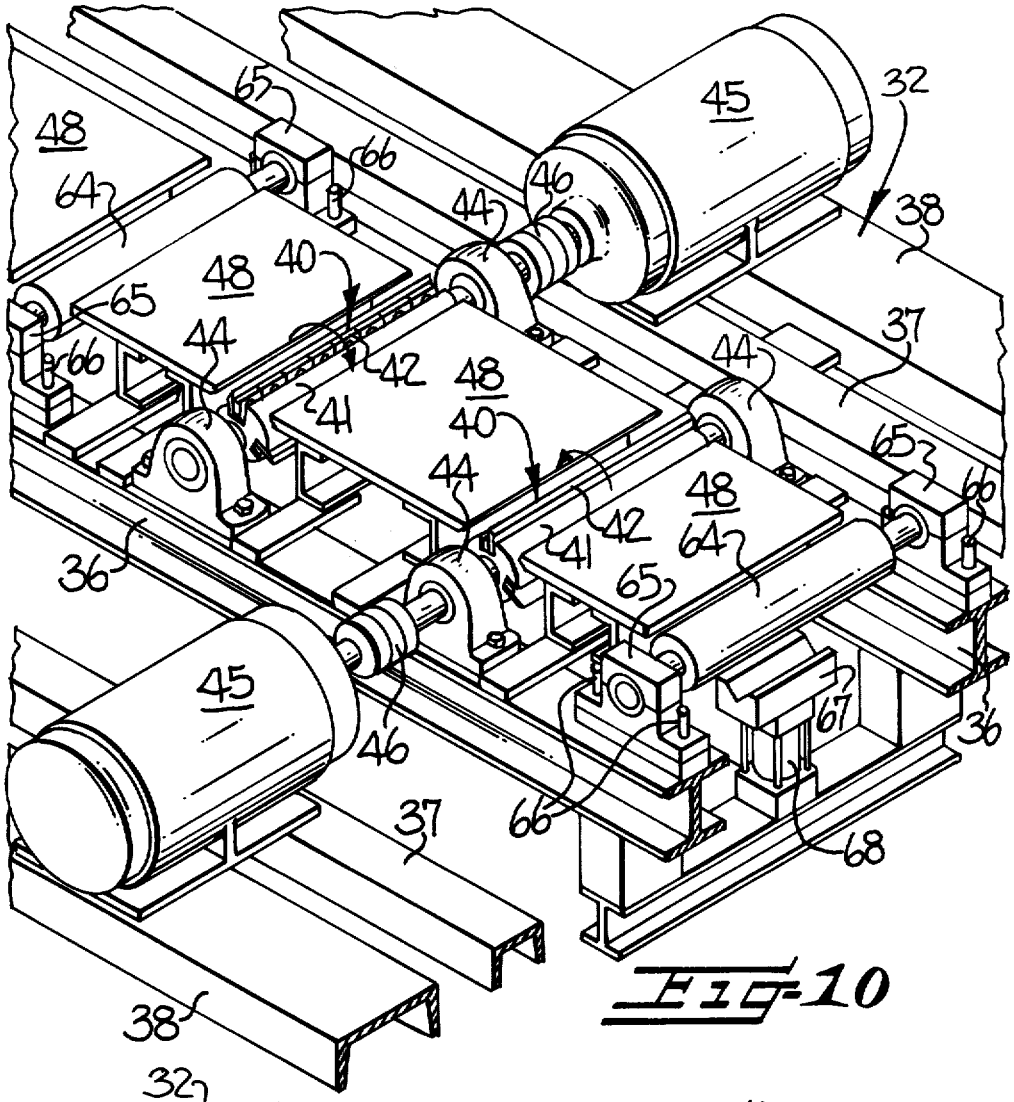
FIG. 10 is a perspective view showing a modified form of the invention wherein adjustable rollers are provided in the carriage for supporting the wood pieces in the hopper.
Figure 11:
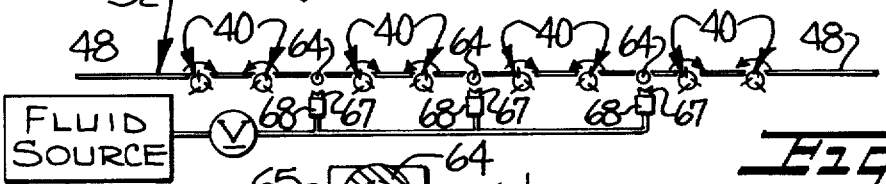
FIG. 11 is a schematic view showing a system for adjusting the position of the rollers.
Figure 12:
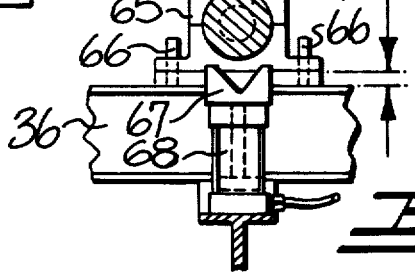
FIG. 12 is a cross sectional view taken substantially along the line 12—12 of FIG. 10 showing the rollers and the associated adjustment mechanism.

The modified form of the invention illustrated in FIGS. 10 to 12 is very similar to that previously described, and to avoid repetitive description the same reference characters are used to identify corresponding parts wherever applicable. Essentially, the modified form of FIGS. 10 to 12 differs over that previously described in that the support members provided on carriage 32 for supporting the wood pieces in the hopper include, in addition to the plates 48, a plurality of support rollers 64. More particularly, as best seen in FIG. 10, rollers 64 are located between each adjacent pair of cutters 40. The rollers 64 are mounted for rotational movement in respective bearing blocks 65 carried by the longitudinally extending beams 36 of the carriage 32. The rollers 64 are mounted with the upper periphery located a short distance below the uppermost extent of the cutter blades 42, but above the upper surface of the support plates 48. The rollers 64 thus serve to bear the weight of the wood pieces in the hopper and serve to reduce the frictional drag between the wood pieces and the underlying carriage during reciprocating movement of the carriage 32 relative to the hopper 31.

The bearing blocks 65 are mounted for vertical sliding movement on upstanding pins 66 carried by the support beams 36 of the carriage. Located beneath each roller 64 is a lift mechanism including a cradle 67 and a fluid actuated cylinder 68. Each cylinder 68 is connected to a source of fluid pressure 69 (FIG. 11). To prevent stalling or binding of the motors 45 during start-up of the cutters, the lift mechanisms may be actuated by applying fluid pressure to each cylinder 68 to thereby move each support roller 64 upwardly a short distance relative to the cutters to lift the wood pieces out of engagement with the cutters. Once the motors are started and the cutters have reached their normal speed of operation, the lift mechanisms may be lowered to bring the wood pieces in the hopper into engagement with the cutter blades.

In the drawings and specification, there have been set forth preferred embodiments of the invention, and although specific terms are employed, they are used in a generic and descriptive sense only and not for purposes of limitation.

That which is claimed is:

1. An apparatus for producing wood shavings comprising:

an elongate open-bottomed stationary hopper adapted for receiving a supply of elongate wood pieces for being formed into wood shavings, an elongate carriage positioned lengthwise beneath said elongate hopper and closely adjacent the open bottom thereof, a series of transversely extending cutters carried by said carriage at spaced locations along the length thereof, said cutters being adapted for engaging the wood pieces in the lowermost portion of said hopper at spaced locations along the length of the pieces and for forming wood shavings from the wood pieces, means mounting said carriage for movement along a predetermined path of travel lengthwise of said elongate hopper, and means for moving said carriage along said path of travel in a reciprocating manner over a predetermined relatively short stroke of movement substantially less than the length of said hopper, and wherein the cutters of said series are so located as to permit said short stroke of movement of said carriage and such that the cutters of said series collectively engage and form shavings from the elongate wood pieces over the entire length of the wood pieces.

2. An apparatus according to claim 1 wherein said series of cutters comprises successive pairs of counter-rotating cutters, one of the cutters of each pair being adapted for forming shavings from the wood pieces during movement of the carriage in one direction, and the other cutter of each pair being adapted for forming shavings from the wood pieces during movement of the carriage in the opposite direction.

3. An apparatus according to claim 2 wherein the reciprocating stroke of movement of said carriage corresponds substantially to the spacing between corresponding cutters of adjacent pairs so that the respective pairs of cutters collectively engage and form shavings from the elongate wood pieces over the entire length of the wood pieces.

4. An apparatus according to claim 2 wherein each of said cutters comprises an elongate generally cylindrical drum extending transversely of the carriage, a plurality of blades extending outwardly from the circumferential surface of the drum, bearing means carried by said carriage, and mounting said cylindrical drum for rotation on said carriage, and an individual motor operatively associated with said drum for rotating the drum at a relatively high speed in a predetermined direction.

5. An apparatus according to claim 1 including respective supports carried by said carriage and positioned between the respective cutters for engaging and supportingly retaining the elongate wood pieces in said open-bottomed hopper during reciprocating movement of the carriage relative to the hopper, and wherein uppermost portions of said supports are positioned so as to lie in a plane located a short distance below uppermost portions of the cutters for controlling the depth of cut of the cutters.

6. An apparatus according to claim 5 wherein said supports for the elongate wood pieces in said hopper comprise plates extending horizontally between adjacent cutters of said series.

7. An apparatus according to claim 5 wherein said supports for the elongate wood pieces in said hopper include rotatably mounted rollers adapted for reducing the frictional drag between the wood pieces in the hopper and the carriage during the reciprocating movement of the carriage relative to the hopper.

8. An apparatus according to claim 7 including means associated with said rollers for moving the rollers upwardly a short distance for lifting the wood pieces out of engagement with the cutters to facilitate starting of the cutters.

9. An apparatus for producing wood shavings comprising:

an elongate stationary hopper adapted for receiving a supply of elongate wood pieces for being formed into wood shavings, said hopper having opposing side walls and opposing end walls with an open top and bottom, an elongate carriage positioned lengthwise beneath said hopper and closely adjacent the open bottom thereof, a series of transversely extending successively arranged cutters carried by said carriage and positioned at spaced locations along the length of the carriage with the overall effective length of the series of cutters being about the same as the length of the hopper, said cutters being adapted for engaging the wood pieces in the lowermost portion of said hopper at a series of spaced locations along the length of the pieces and for forming wood shavings from the wood pieces, means mounting said carriage for movement along a predetermined path of travel lengthwise of said elongate hopper, and means for moving said carriage along said path of travel in a reciprocating manner over a predetermined relatively short stroke of movement substantially less than the length of said hopper, and wherein the cutters of said series are so located as to permit said short stroke of movement of said carriage and such that the cutters of said series collectively engage and form shavings from the elongate wood pieces over the entire length of the wood pieces.

10. An apparatus according to claim 9 including conveyor means operatively associated with said stationary hopper for supplying the hopper with elongate wood pieces.

11. An apparatus according to claim 9 including conveyor means associated with said carriage and extending therefrom to a remote location for receiving the wood shavings produced by the cutters and for transporting the same to the remote location.

12. An apparatus for producing wood shavings comprising:

an elongate open-bottomed stationary hopper adapted for receiving a supply of elongate wood pieces for being formed into wood shavings, conveyor means operatively associated with said stationary hopper for receiving elongate wood pieces and delivering the same to the hopper, an elongate carriage positioned beneath said hopper and closely adjacent the open bottom thereof, a series of transversely extending cutters carried by said carriage and arranged in successive pairs of counter-rotating cutters at longitudinally spaced locations along the length of the carriage and adapted for engaging the elongate wood pieces in the lowermost portion of said hopper at a series of spaced locations along the length of the pieces and for forming wood shavings from the wood pieces, means mounting said carriage for movement along a predetermined path of travel lengthwise of said elongage hopper, means for moving said carriage along said path of travel in a reciprocating manner over a predetermined relatively short stroke of movement substantially less than the length of the hopper, and, wherein the cutters of said series are so located as to permit said short stroke of movement of said carriage and such that the cutters of said series collectively engage and form shavings from the elongate wood pieces over the entire length of the wood pieces, a loading facility located remotely of said carriage and adapted for facilitating loading the wood shavings into a motor vehicle, and conveyor means underlying said carriage and extending therefrom to said loading facility and being operable for receiving the wood shavings produced by said cutters and for transporting the same to said remote loading facility.

13. An apparatus for producing wood shavings comprising:

an elongate stationary hopper adapted for receiving a supply of elongate wood pieces for being formed into wood shavings, said hopper having opposing side walls and opposing end walls with an open top and bottom, an elongate carriage positioned lengthwise beneath said hopper and closely adjacent the open bottom thereof, a series of transversely extending cutters carried by said carriage and arranged in successive pairs of counter-rotating cutters at longitudinally spaced locations along the length of the carriage and adapted for engaging the elongate wood pieces in the lowermost portion of said hopper at spaced locations along the length of the pieces with one of the cutters of each pair being adapted for forming shavings from the wood pieces during movement of the carriage in one direction, and the other cutter of each pair being adapted for forming shavings from the wood pieces during movement of the carriage in the opposite direction, an elongate trackway underlying said hopper and said carriage and extending lengthwise thereof and beyond the ends of said hopper and carriage, wheel means carried by said carriage and cooperating with said elongate trackway so as to mount said carriage for movement along a predetermined path of travel lengthwise of said elongate hopper, and means for moving said carriage along said trackway in a reciprocating manner and over a predetermined relatively short stroke of movement substantially less than the length of said hopper and at least as great as the spacing between corresponding cutters of adjacent pairs, and wherein the cutters of said series are so located as to permit said short stroke of movement of said carriage and such that the respective pairs of cutters of said series collectively engage and form shavings from the elongate wood pieces over the entire length of the wood pieces.

14. An apparatus according to claim 13 wherein said hopper and said carriage are of substantially the same length and said elongate trackway extends a distance sufficient to permit moving the carriage along said trackway from beneath the hopper to provide access to the cutters for servicing and sharpening.

15. An apparatus according to claim 13 including conveyor means underlying said carriage and extending therefrom to a remote location, said conveyor means being operable for receiving the wood shavings produced by said cutters and for transporting the same to the remote location.

16. An apparatus according to claim 13 including conveyor means extending from a location adjacent one side of said elongate stationary hopper to the open upper end of the hopper for delivering a supply of the elongate wood pieces to the hopper.

17. An apparatus according to claim 16 wherein said conveyor means includes a first portion at said location adjacent one side of the hopper adapted for receiving the elongate wood pieces in piles from a loading vehicle, and including a second portion associated with said first portion for delivering the wood pieces from the piles individually and successively to said stationary hopper.

18. An apparatus according to claim 17 wherein said second portion of said conveyor means includes a continuously operating smooth-surfaced conveyor terminating adjacent one side of said hopper and operating at a rate such as would oversupply the hopper with wood pieces, and wherein the wood pieces present in the upper portion of the hopper, when filled, prevent additional pieces from being delivered into the hopper and cause the smooth-surfaced conveyor to move beneath the wood pieces until additional wood pieces can be accommodated in the hopper whereby the hopper is continuously kept filled with wood pieces.

* * * * *